United States Patent [19]

Shimizu

[11] Patent Number: 4,639,706

[45] Date of Patent: Jan. 27, 1987

[54] FLYBACK TRANSFORMER

[75] Inventor: Yohei Shimizu, Nishinomiya, Japan

[73] Assignee: Sanyo Electric Co., Ltd., Osaka, Japan

[21] Appl. No.: 784,440

[22] Filed: Oct. 4, 1985

[30] Foreign Application Priority Data

Oct. 30, 1984 [JP] Japan ..... 59-164020[U]

[51] Int. Cl.[4] ..... H01F 27/30

[52] U.S. Cl. ..... 336/170; 336/96; 336/185; 336/192; 336/198

[58] Field of Search ..... 336/192, 198, 208, 96, 336/185, 170; 310/71, 194

[56] References Cited

U.S. PATENT DOCUMENTS

| | | | |
|---|---|---|---|
| 3,112,898 | 12/1963 | Stahl | 336/198 X |
| 3,946,350 | 3/1976 | Goto | 336/208 |
| 4,204,263 | 5/1980 | Onoue | 336/185 X |
| 4,257,027 | 3/1981 | Yasuhisa | 336/208 X |
| 4,403,403 | 9/1983 | Hosoya et al. | 336/96 X |
| 4,449,111 | 5/1984 | Nakajima | 336/198 X |
| 4,510,478 | 4/1985 | Finkbeiner | 336/208 X |

FOREIGN PATENT DOCUMENTS

| | | | |
|---|---|---|---|
| 2311612 | 9/1973 | Fed. Rep. of Germany | 336/208 |
| 2310974 | 9/1973 | Fed. Rep. of Germany | 336/198 |
| 2422236 | 12/1979 | France | 336/208 |
| 13929 | 2/1979 | Japan | 336/208 |

*Primary Examiner*—Thomas J. Kozma

*Attorney, Agent, or Firm*—Armstrong, Nikaido, Marmelstein & Kubovcik

[57] ABSTRACT

A flyback transformer wherein the tertiary coil is wound on an auxiliary bobbin provided separately, insertedly on the low tension coil bobbin for the primary coil, thereby to render to insulate completely the tertiary coil from the primary coil.

3 Claims, 13 Drawing Figures

FLYBACK TRANSFORMER

BACKGROUND OF THE INVENTION

1. Field of the Invention

The present invention relates to a flyback transformer for use in an electronic apparatus such as a television receiver and the like.

2. Description of the Prior Art

In a conventional flyback transformer, a low tension coil bobbin has been employed with an insulating construction as shown in FIGS. 1 to 3 for winding both a primary coil 1 and tertiary coil 2 thereon. The low tension coil bobbin 3 provides an upper cylindrical hollow portion 4 for the primary coil 1, a lower cylindrical hollow portion 5 for the tertiary coil 2, and a terminal board 6 providing a plurality of connecting terminals 7. The primary coil 1 is wound on the upper hollow portion 4, the terminal ends of which being drawn out from the upper hollow portion 4 to the terminal board 6 through the lower hollow portion 5 to be connected with the connecting terminals 7, while the tertiary coil 2 is wound on the lower hollow portion 5 through a sheet or tape 8 of insulating materials such as Mylar tape (Mylar is a trade name owned by E. I. du Pont de Nemours & Co., Inc. of the U.S.A.) to be provided between the tertiary coil 2 and the terminal end of the primary coil 1 drawn out from the upper hollow portion 4 to the terminal board 6, as shown in FIG. 3, the terminal ends of the tertiary coil 2 being drawn out from the lower hollow portion 5 to the terminal board 6 to be connected with the connecting terminals 7. It is to be noted that not only the application of the Mylar tape on the terminal end of the primary coil 1 is a kind of work inducing trouble such as mislocations of the tape 8, taking a lot of time for putting the tape 8 in the right position, but also the property of the Mylar tape is not absolutely enough for the insulation between the primary coil 1 and tertiary coil 2 in the case of that the flyback transformer is used as an electronic apparatus under various circumstances. If there suddenly occurs a short-circuit between the primary and tertiary coils 1 and 2 of the flyback transformer used in the electronic apparatus, the apparatus is rendered less safe for the operator because the power source connected to the primary coil 1 is directly connected to signal lines connected to the tertiary coil 2 such as a video terminal, RGB terminal or the like which lead outside from the cabinet of the apparatus. Therefore, in the field of electronic apparatuses, it is desired to provide a flyback transformer of a type in which the tertiary coil 2 is completely insulated from the primary coil 1 in order to prevent from making trouble of short-circuit therebetween in any situation of the transformer.

SUMMARY OF THE INVENTION

Accordingly, an essential object of the present invention is to provide a flyback transformer of the type referred to above which can eliminate the disadvantages inherent in the conventional one, and in which a primary coil and a tertiary coil are respectively provided in the state of insulated separation with each other.

Another object of the present invention is to provide a flyback transformer for use in an electronic apparatus which is simple in construction, easy in assembling and safe in operation.

According to one preferred embodiment of the present invention, there is provided a flyback transformer which comprises a low tension coil bobbin including a cylindrical hollow portion for winding a primary coil thereon, a terminal board for providing a plurality of connecting terminals, and a cylindrical compartment portion provided between the hollow portion and terminal board and with a first passage for guiding the primary coil from the hollow portion to the terminal board through the compartment portion and a second passage for guiding a tertiary coil from the compartment portion to the terminal board, and an auxiliary bobbin insertedly mounted onto the compartment portion of the low tension coil bobbin for winding thereon the tertiary coil to be electrically separated from the first coil wound on the hollow portion of the low tension coil bobbin, and provided with an auxiliary passage for guiding the tertiary coil from the auxiliary coil to the terminal board through the second passage.

The flyback transformer of the present invention is constructed such that, since the tertiary coil is wound on the auxiliary bobbin separately provided with and insertedly mounted on the low tension coil bobbin for the primary coil, the tertiary coil is completely insulated from the primary coil through the auxiliary bobbin which can be easily formed of materials with adequate electrical insulation properties in various dimensions.

BRIEF DESCRIPTION OF THE DRAWINGS

These and other objects and features of the present invention will become apparent from the following description taken in conjunction with a preferred embodiment thereof with reference to the accompanying drawings, throughout which like parts are designated by like reference numerals, and in which.

DESCRIPTION OF THE PREFERRED EMBODIMENT

Figure 4:
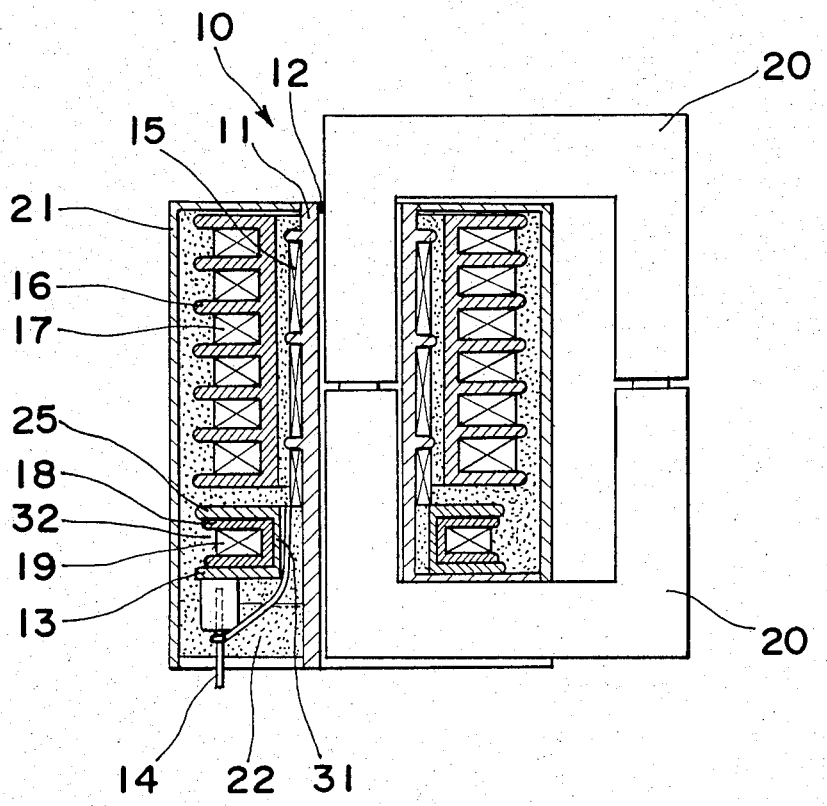
FIG. 4 is a cross-sectional view of a flyback trransformer in accordance with one preferred embodiment of the present invention.

Referring to FIG. 4, there is shown a flyback transformer 10, according to one preferred embodiment of the present invention, which comprises a cylindrical low tension coil bobbin 11 having a penetrating hole 12 at its axial center and a terminal board 13 at its lower end for supporting a plurality of connecting terminals 14 thereon, a primary coil 15 wound on the outer surface of the low tension coil bobbin 11, a cylindrical high tension coil bobbin 16 provided concentrically around the low tension coil bobbin 11 with a given gap provided therebetween, a secondary coil 17 wound on the outer surface of the high tension coil bobbin 16, a cylindrical auxiliary bobbin 18 provided below the high tension coil bobbin 16 and mounted concentrically, detachably on the lower portion of the low tension coil bobbin 11, a tertiary coil 19 wound on the outer surface of the auxiliary bobbin 18, a pair of cores 20, 20 forming a closed frame of square shape, one side of which passes through the hole 12 of the low tension coil bobbin 11 to surround all the primary, secondary and tertiary coils 15, 17, 19, and a housing 21 for accommodating all of the bobbins 11, 16, 18 and coils 15, 17, 19 therein with insulating resin 22 provided thereamong except for the connecting terminals 14 connected to the respective terminal ends of the coils 15, 17 and 19 and exposed at their ends to the outside of the housing 21.

Within the housing 21, the primary coil 15 of the low tension coil bobbin 11 is separated by insulation from the second coil 16 through the high tension coil bobbin 16 and insulating resin 22, and from the tertiary coil 19 through the auxiliary bobbin 18, while the secondary coil 17 is separated from the tertiary coil 19 through the high tension coil bobbin 16, auxiliary bobbin 18 and insulating resin 22. Each of the connecting terminals 14 of the coils 15, 17, 19 will be connected with the respective part of the electronic apparatus such as a video terminal, RGB terminal or the like in a known manner.

Figure 1:
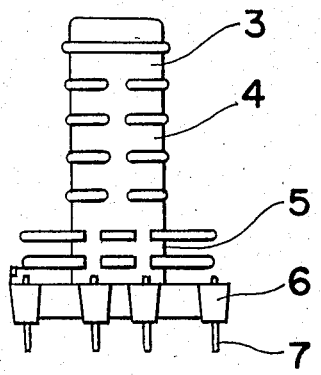
Fig. 1 PRIOR ART
FIG. 1 is a front view of a low tension coil bobbin for use in a conventional flyback transformer (already referred to)
Figure 2:
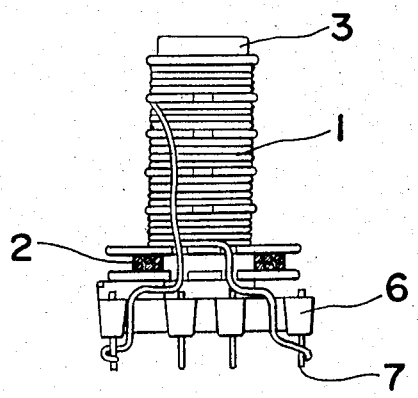
Fig. 2 PRIOR ART
FIG. 2 is a view similar to FIG. 1, with both a primary coil and a tertiary coil provided around the bobbin.
Figure 3:
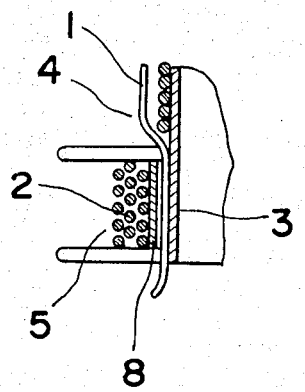
Fig. 3 PRIOR ART
FIG. 3 is a cross-sectional view, on an enlarged scale, showing a portion of the bobbin and coils of FIG. 2.

In the above arrangement, the housing 21, cores 20, 20 and high tension coil bobbin 16 are similar to those of conventional ones in construction, but the low tension coil bobbin 11 and auxiliary bobbin 18 which are constructed with specific, novel features on the improvement over the conventional ones of FIGS. 1 to 3, respectively, are disclosed hereinafter in connection with FIGS. 5 to 13.

Figure 5:
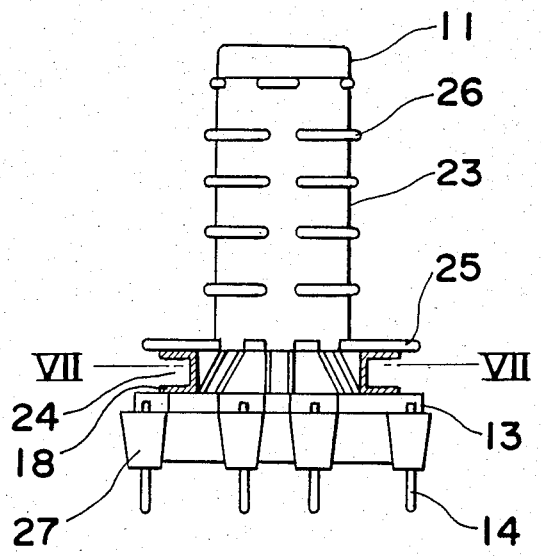
FIG. 5 is a front view of a low tension coil bobbin provided with an auxiliary bobbin, shown in cross-section, for use in the flyback transformer of FIG. 4.
Figure 10:
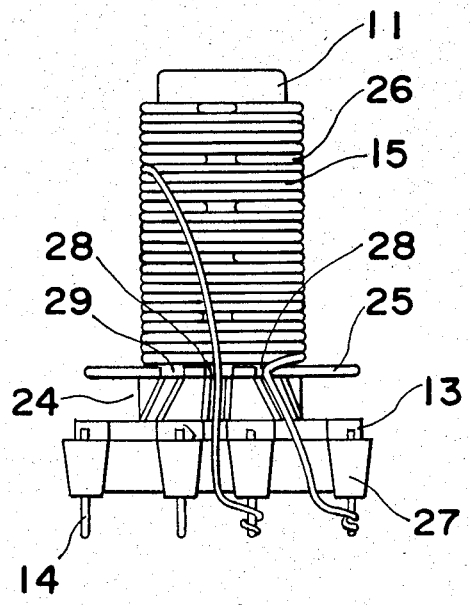
FIG. 10 is a front view of the low tension coil bobbin of FIG. 5, with a primary coil provided around the bobbin.

Referring now to FIG. 5, the low tension coil bobbin 11 is made of insulating materials as one unit including a cylindrical hollow portion 23 for winding the primary coil 15 thereon, the terminal board 13 provided with connecting terminals 14 projecting in parallel relation with the penetrating hole 12, and a purality of legs 27 radially extending outwardly about the penetrating hole 12, and a cylindrical compartment portion 24 provided between the hollow portion 23 and terminal board 13 for mounting insertedly the auxiliary bobbin 18 therein, the hole 12 (FIG. 6) being provided to penetrate the hollow portion 23, compartment portion 24 and terminal board 13 in a straight line. On the boundary between the hollow portion 23 and compartment portion 24, there is provided a flange 25 for partitioning the primary coil 15 wound on the hollow portion 23 against the auxiliary bobbin 18 to be inserted into the compartment portion 24, so that the compartment portion 24 is created by the flange 25 and terminal board 13 forming its upper and lower sides. A plurality of projections 26 are provided stepwisely on the hollow portion 23 for dividing its outer surface into several sections along the axial direction, on which the primary coil 15 is wound in order to be separated by the projections 26 as shown in FIG. 10. Along the flange 25, compartment portion 24 and terminal board 13 there is provided a pair of first axial passages 28, 28 composed of notches or grooves for inserting therein the terminal ends of primary coil 15 so that the terminal ends of primary coil 15 are guided from the hollow portion 23 to the connecting terminals 14 through the respective first passages 28 to bypass the auxiliary bobbin 18 to be inserted into the compartment portion 24.

As shown in FIG. 10, the primary coil 15 is provided on the low tension coil bobbin 11 in such a manner that the primary coil 15 is first connected at one terminal end to one of the connecting terminals 14 by solder, is then guided upwardly through one of the first passages 28 to the hollow portion 23, is wound spirally around the hollow portion 23 section by section under the guide of projections 26 to form a coil having a given number of winding turns, is again guided downwardly at the other terminal end from the hollow portion 23 to the terminal board 13 through the other of first passages 28, and is finally connected with the other of connecting terminals 14 at the other terminal end by solder.

Also, there is provided a second passage 29 similar to the first passages 28 along the flange 25, compartment portion 24 and terminal board 13 for inserting a terminal end of primary coil 15 if needed to lead it to a proper terminal pin. By the way, the terminal ends of secondary coil 17 are wound on the high tension coil bobbin 16 positioned around the hollow portion 23 of low tension coil bobbin 11 so that the terminal ends of secondary coil 17 are guided from the connecting terminals 14 of the terminal board 13 to the high tension coil bobbin 16 to bypass the auxiliary bobbin 18.

The compartment portion 24 is provided as a kind of cylindrical space comprising flange 25 and terminal board 13 and a cylindrical wall 31 (FIG. 4) having an opening 32 facing the outside to be adapted to insert the auxiliary bobbin 18 into the compartment portion 24 from the outside, the opening 32 having dimensions of height determined by the flange 25 and terminal board 13 and of length larger than the width of the primary coil 15 wound on the hollow portion 23.

Figure 6:
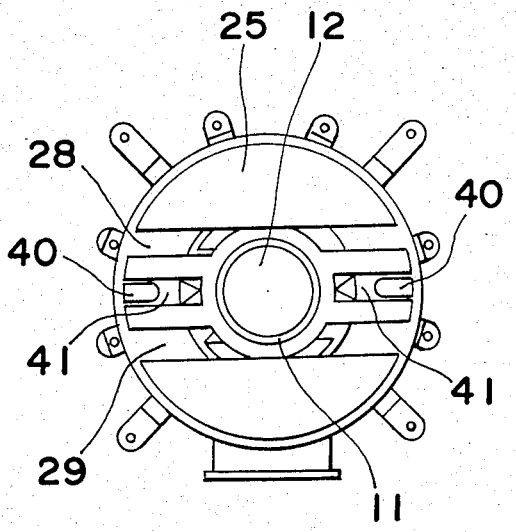
FIG. 6 is top plan view of FIG. 5.
Figure 7:
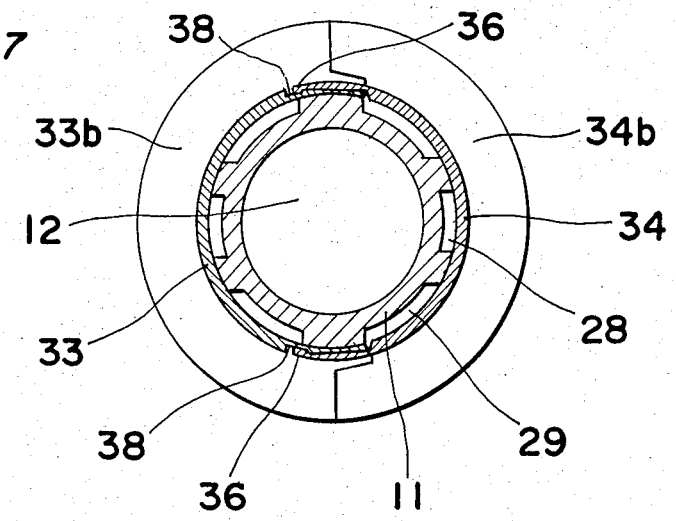
FIG. 7 is a cross-sectional view of the bobbins taken along a line of VII—VII of FIG. 5.
Figure 8:
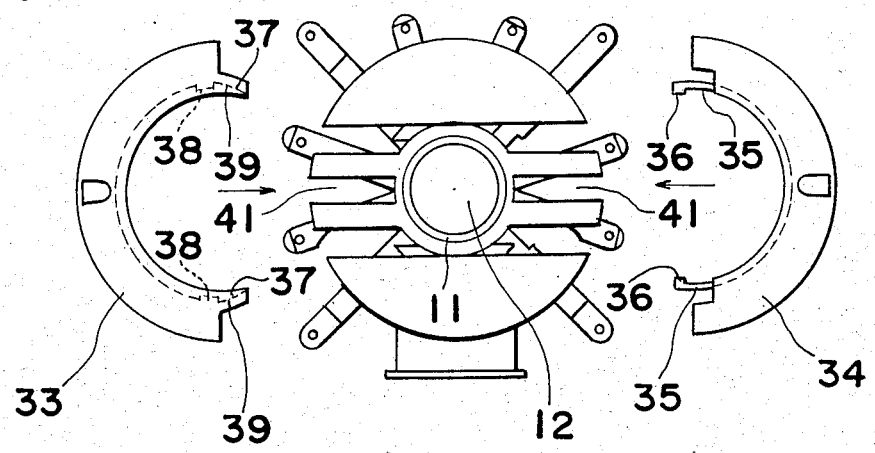
FIG. 8 is a similar view of FIG. 6, with the auxiliary bobbin disassembled from the low tension coil bobbin.
Figure 9:
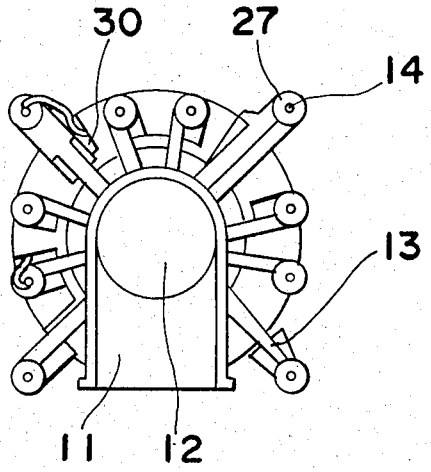
FIG. 9 is a bottom plan view of FIG. 5, but showing both the connecting ends of the primary coil and a tertiary coil spliced onto the respective terminals.
Figure 11:
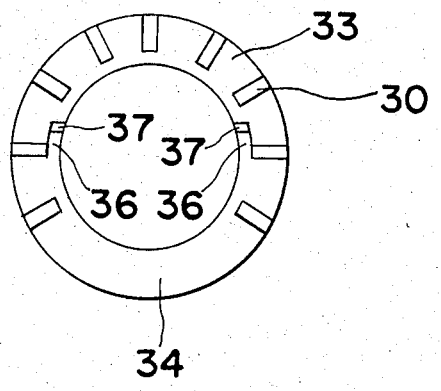
FIG. 11 is a bottom plan view of the auxiliary bobbin shown in FIG. 5.
Figure 12:
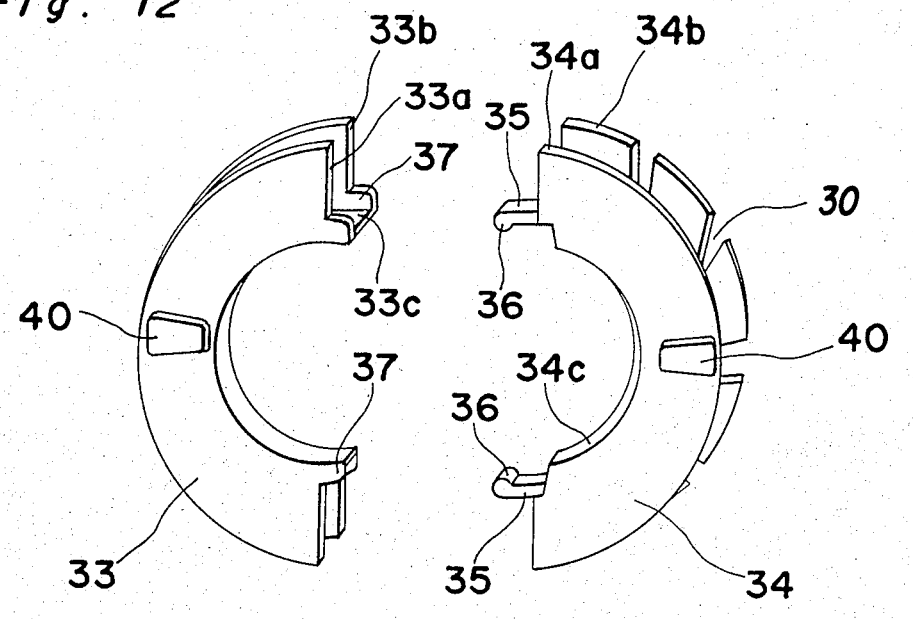
FIG. 12 is a perspective view, taken from the top plane, of the auxiliary bobbin, disassembled into a pair of shells, of FIG. 11.

The auxiliary bobbin 18 comprises, as shown in FIG. 12, a pair of half rings or semi-annular frame members 33, 34 each made of insulating materials and detachably engaged with the other at their both ends to form one complete ring with a groove in a cross-section of a horizontal U-shape including a pair of flanges 33*a*, 33*b*, 34*a*, 34*b* and a cylindrical wall portion 33*c*, 34*c* for winding the tertiary coil 19 thereon, the dimensions of the ring being slightly smaller than those of the compartment portion 24 so that the ring is easily, fittedly inserted into the compartment portion 24. One 34 of the half rings is provided at both ends with fingers 35, 35 projecting to the outside with lobes 36, 36 disposed at their ends and directed to the interior, while the other 33 of the half rings is provided at both ends with lips 37, 37 projecting to the outside with recesses 38, 38 disposed at its bases and directed to the exterior, each of the lobes 36, 36 being able to fit detachably with the respective recesses 38, 38 to establish an engagement between the pair of half rings 33, 34, resulting in one ring, as shown in FIGS. 7 and 11. For facilitating the engagement thereof, it is preferable to provide on the upper surface of each of the lips 37, 37 a tapered plane 39 for guiding the lobes 36 from the outside into the recession 38. Also, each of the half rings 33, 34 includes on the outer surface of its upper-side flange a protrusion or lug 40 for fitting detachably into a notch 41 provided on the flange 25 of the low tension coil bobbin 11 in order to secure the position of the half rings 33, 34 within the compartment portion 24 of the low tension coil bobbin 11, as shown in FIGS. 6 and 8. In addition, each of the half rings 33, 34 includes on its lower-side flange plural passages or notches 42 for inserting the terminal ends of the tertiary coil 19 to be wound on the auxiliary bobbin 18 and guided to the connecting terminals 14.

To assemble the auxiliary bobbin 18 into the compartment portion 24 of low tension coil bobbin 11, at a first step, one 34 of the half rings is brought into place at one side of the compartment portion 24 facing the protrusion 40 to one notch 41 of the flange 25, while the other 33 of the half rings is placed at the opposite side of the compartment portion 24 in facing the protrusion 40 to the other side notch 41 of the flange 25, as shown in FIG. 8, the lobes 36, 36 of one half ring 34 coming in place to face to the recesses 38, 38 of the other half ring 33 via the compartment portion 24 of the low tension coil bobbin 11.

At the next step, the pair of half rings 33, 34 are inserted into the compartment portion 24 upon fitting their protrusions 40, 40 with the respective notches 41, 41 of the flange 25, and the lobes 36, 36 are finally engaged with the corresponding recesses 38, 38, whereby the pair of half rings 33, 34 are detachably mounted within the compartment portion 24 of the low tension coil bobbin 11 to form one complete ring, i.e., the auxiliary bobbin 18, as shown in FIGS. 6 and 7, under placing the pair of flanges 33*a*, 34*a*, 33*b*, 34*b*, wall portion 33*c*, 34*c* at given positions close to the flanges 25, 13 and wall 31 of the low tension coil bobbin 11, respectively, as shown in FIG. 4.

Then, the tertiary coil 19 is wound on the auxiliary bobbin 18 mounted within the compartment portion 24 in such a manner that the tertiary coil 19 is first connected at one terminal end onto one of the connecting terminals 14 by solder, is guided upwardly from the terminal board 13 into the auxiliary bobbin 18 through one of the third passages 30 of the auxiiary bobbin 18, is wound spirally around the wall portion 33*c*, 34*c* of the auxiliary bobbin 18 to form a coil of a given number of winding turns surrounded by the pair of flanges 33*a*, 34*a*, 33*b*, 34*b* of the auxiliary bobbin 18, is again guided downwardly at its other terminal end to the terminal board 13 through the other of the third passages 30, and is finally spliced connected to the other of connecting terminals 14 at the other terminal end by solder. With the above arrangement, the tertiary coil 19 mounted on the auxiliary bobbin 18 is rendered separate from the primary coil 15 mounted on the hollow portion 23 of the low tension coil bobbin 11 by the auxiliary bobbin 18 made of the insulation materials, so that there is no chance of occurrence of troubles caused in the insulation between the primary coil 15 and tertiary coil 18. Thereafter, the high tension coil bobbin 16 for the secondary coil 17 and the pair of cores 20, 20 are provided in a known manner in relationship with the low tension coil bobbin 11, and, finally, the housing 21 is provided to secure fixedly all the bobbins 11, 16, 18, coils 15, 17, 19 and cores 20, 20 in the given positions by means of the molding resin 22 provided within the housing 21, as shown in FIG. 4.

Figure 13:
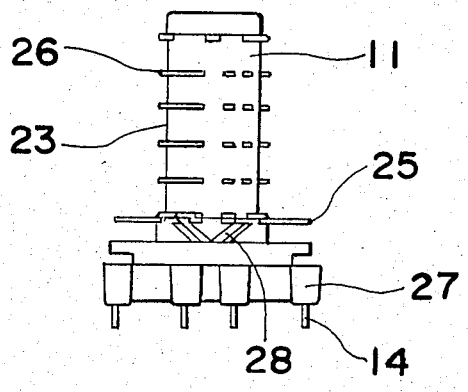
FIG. 13 is a front view of a low tension coil bobbin for use in a flyback transformer in accordance with a modification of the present invention.

Although the present invention has been fully described in connection with the preferred embodiments thereof with reference to the accompanying drawings, it is to be noted that various changes and modifications are apparent to those skilled in the art. By way of example, the first passages 28 may be provided with various kinds of configurations, for instance, such as shown in FIG. 13. Such changes and modifications are to be understood as included within the scope of the present invention as defined by the appended claims unless they depart therefrom.

What is claimed is:

1. A flyback transformer which comprises:

a low tension coil bobbin including a hollow cylindrical portion surrounded by a primary coil winding having terminal ends, a terminal board provided with a plurality of legs supporting connecting terminals, and a flange portion axially spaced a predetermined distance from said terminal board and forming a substantially cylindrical compartment portion below said hollow cylindrical portion, said low tension coil bobbin further including a plurality of first passage means formed axially in said cylindrical compartment portion leading said primary coil winding terminal ends from said hollow cylindrical portion through said cylindrical compartment portion to said connecting terminals;

a high tension coil bobbin concentrically disposed at an outer peripheral portion of said hollow cylindrical portion of said low tension coil, bobbin extending a predetermined distance along said hollow cylindrical portion and being wound with a secondary coil around an outer portion thereof; and an auxiliary coil bobbin composed of insulating material, including a pair of semi-annular frame members of U-shaped cross section fitted into said cylindrical compartment portion of said low tension coil bobbin and joined together so as to define an annular groove in which a tertiary coil is wound, said tertiary coil being electrically separated from said terminal ends of said primary coil winding passing through said first passage means by said auxiliary coil bobbin, said auxiliary coil bobbin being formed with a plurality of second passage means guiding terminal ends of said tertiary coil winding to said connecting terminals.

2. A flyback transformer as recited in claim 1, wherein said auxiliary coil bobbin is formed with a protrusion on an outer surface of an upper-side flange portion of each semi-annular frame member and said flange portion of said low tension coil bobbin is formed with a pair of radial notches into which said protrusions are fitted to guide assembly of said semi-annular frame members and to secure the position of said auxiliary bobbin in said cylindrical compartment portion.

3. A flyback transformer as recited in claim 1, wherein said semi-annular frame members each include a semi-cylindrical inner wall portion, one of said semi-cylindrical wall portions being formed with a projecting finger at each end having an inwardly directed lobe thereon, and the other of said semi-cylindrical wall portions being formed with exterior recesses and lips forming a tapered plane, whereby said finger lobes are guided into said recesses when said frame members are fitted together to thereby maintain engagement between said frame members.

* * * * *